US008186086B2

(12) United States Patent
Gur-Ari et al.

(10) Patent No.: US 8,186,086 B2
(45) Date of Patent: May 29, 2012

(54) MAGAZINE STATUS INDICATOR WITH GRADUATED TAPE

(76) Inventors: Ori Gur-Ari, Ramat-HaSharon (IL); Uri Feigin, Ramat-HaSharon (IL)

( * ) Notice: Subject to any disclaimer, the term of this patent is extended or adjusted under 35 U.S.C. 154(b) by 263 days.

(21) Appl. No.: 12/598,078

(22) PCT Filed: Apr. 29, 2008

(86) PCT No.: PCT/IL2008/000565

§ 371 (c)(1),
(2), (4) Date: Nov. 10, 2009

(87) PCT Pub. No.: WO2008/132739

PCT Pub. Date: Nov. 6, 2008

(65) Prior Publication Data

US 2010/0115815 A1 May 13, 2010

Related U.S. Application Data

(60) Provisional application No. 60/914,770, filed on Apr. 30, 2007.

(51) Int. Cl.
*F41A 9/62* (2006.01)

(52) U.S. Cl. ..... 42/1.02; 42/1.01; 42/7

(58) Field of Classification Search ..... 42/1.01–1.05, 42/7, 11, 49.01, 70.02
See application file for complete search history.

(56) References Cited

U.S. PATENT DOCUMENTS

| | | | | |
|---|---|---|---|---|
| 1,202,768 | A | 10/1918 | Arnold | |
| 4,587,756 | A * | 5/1986 | Jakubaschk et al. | 42/50 |
| 5,005,307 | A * | 4/1991 | Horne et al. | 42/1.02 |
| 5,052,138 | A * | 10/1991 | Crain | 42/1.02 |
| 5,142,805 | A * | 9/1992 | Horne et al. | 42/1.02 |
| 5,206,444 | A | 4/1993 | Oliver | |
| 5,291,679 | A * | 3/1994 | Wollack et al. | 42/50 |
| 5,592,769 | A * | 1/1997 | Villani | 42/1.02 |
| 5,642,581 | A | 7/1997 | Herold | |
| 5,799,432 | A | 9/1998 | Wright, Sr. et al. | |
| 6,094,850 | A * | 8/2000 | Villani | 42/1.02 |
| 7,032,342 | B2 * | 4/2006 | Pikielny | 42/146 |
| 7,536,816 | B2 * | 5/2009 | Weinberger | 42/1.02 |
| 7,661,217 | B2 * | 2/2010 | Pikielny | 42/1.01 |
| 7,716,863 | B1 * | 5/2010 | Johnson et al. | 42/1.02 |
| 7,730,654 | B2 * | 6/2010 | Kim | 42/1.02 |
| 7,802,391 | B2 * | 9/2010 | Quinn et al. | 42/1.03 |
| 2006/0053671 | A1 | 3/2006 | Weinberger | |

FOREIGN PATENT DOCUMENTS

GB 101797 1/1917

OTHER PUBLICATIONS

International Search Report of the International Searching Authority for PCT/IL2008/000565 dated Feb. 12, 2009.
Written Opinion of the International Searching Authority for PCT/IL2008/000565 dated Feb. 12, 2009.
Office Action issued by the Israeli Patent Office, dated Oct. 11, 2010 in corresponding Israeli patent application No. 188397.

* cited by examiner

*Primary Examiner* — Michael David
(74) *Attorney, Agent, or Firm* — Pearl Cohen Zedek Latzer, LLP

(57) ABSTRACT

The present invention provides a magazine with an indicator displaying the number of cartridges present therein. The magazine has a graduated tape having printed thereupon, a series of numbers representing the number of cartridges present in the magazine. A portion of the tape is displayed in an indicator window present on the magazine housing, to show an indication of the number of cartridges remaining in said magazine.

14 Claims, 4 Drawing Sheets

MAGAZINE STATUS INDICATOR WITH GRADUATED TAPE

CROSS-REFERENCE TO RELATED APPLICATIONS

This application is a National Stage of an international application No. PCT/IL2008/000565, filed Apr. 29, 2008, which is incorporated herein by reference in its entirety, which in turn claimed the benefit of U.S. Provisional Patent Application 60/914,770, filed Apr. 30, 2007, and also claims the benefit of IL Patent Application No. 188379, filed Dec. 24, 2007, both of which are incorporated by reference herein.

FIELD OF THE INVENTION

The present invention relates generally to firearm magazines, and more particularly, the invention relates to indication of the number of cartridges within a firearm magazine as well as the ability to retro-fit standard or modified magazines.

BACKGROUND OF THE INVENTION

Hesitation during a live-ammunition firefight, can lead to loss of life. A well-known problem exists, in recognizing when it is necessary to reload a weapon, which, during warfare, is preferably performed in the shortest amount of time possible. Advance notice of depletion of the cartridges within the weapon is useful, allowing the user to best select the timing of when to reload his weapon. Additionally, for weapon safety, there are instances when it is necessary to ascertain whether or not a cartridge is present in the barrel.

Prior art publications have addressed this issue in several ways. Electronic displays have been developed, mostly for small arms, which indicate by means of a digital display panel, the number of rounds remaining. For instance, U.S. Pat. No. 5,799,432 to Wright et al., U.S. Pat. No. 5,642,581 to Herold et al, and U.S. Pat. No. 5,052,138 to Crain, relate to small-arms having electronic counting and electronic display means. The disadvantages associated with electronic displays are their sensitivity to humidity, which cannot be controlled in battlefield conditions, and their reliance on a power source such as a battery, which may be suddenly and inconveniently depleted.

Additionally, a light-emitting display is unwanted during a firefight for obvious reasons.

Often, in prior art, the weapon itself is modified to include a display, and not merely the magazine, representing an added expense, and retro-fitting of existing firearms is this not be possible.

Alternatively, magazines with a transparent area of housing, have been developed, so that cartridges may be viewed within. A glance at the magazine gives a general indication whether reloading is necessary, as the user can estimate whether there are many or few cartridges left. However, the magazine needs to be removed from within the weapon in order to view the transparent area, since the majority of the magazine is located within the opaque grip of the weapon. The last few cartridges are always located at the uppermost part of the magazine, so that the entire magazine needs to be removed from the weapon in order to view them. Thus, during use of the magazine, an additional step is required to check the number of cartridges, which is especially disadvantageous during a live firelight.

U.S. Pat. No. 5,149,897, issued Sep. 22, 1992, to Howard, describes one such see-through polyamide magazine in which cartridges within the magazine are visible through the walls. A number of integral translucent windows are present between internal ribs of the magazine.

Unfortunately, such magazines are not suitable for all types of automatic assault weapons, since many magazines for machine guns and submachine gun, have thin housings, which, if made of transparent plastic, would crack under battlefield conditions. For instance, the magazine suited for an M16 assault rifle has a relatively thin housing which cannot be manufactured of transparent plastic.

Wollack, et al, in U.S. Pat. No. 5,291,679, issued Mar. 8, 1994, disclose a magazine with an elongated indicator member attached to the follower and projecting outside the body of the magazine so that the length of the indicator member indicates how many bullets remain in the aperture. The indicator member is provided with a series of knots at predetermined intervals so that the number of knots on the portion of the indicator member projecting outside the body of the magazine equals the number of bullets remaining in the magazine. More elaborately, each knot can correspond to a predetermined number of remaining bullets, or the knots can vary in configuration to provide a tactile code of the number of remaining bullets so that the user only needs to feel the knot closest to the magazine to determine the number of bullets remaining.

U.S. Pat. No. 4,587,756, to Jakubaschk et al, issued May 13, 1986, discloses a magazine for a small arm. In one option, the follower spring, which advances the follower plate upon which the cartridges rest, may be viewed via a transparent window, and one portion of the spring is colored differently than the rest of the spring. A user may view which color is apparent through the window, and may determine whether the color is associated with a full or near-empty magazine. In another option, described in relation to FIG. 4, movement of the follower spring, rotates a disk 104, which has a pointer or other numerical indication of the ammunition level remaining. The Jakubaschk patent contains numerous components, raising the cost of manufacture, and the likelihood of failure of the mechanism. Additionally, the Jakubaschk magazine is lengthened and non-standardized compared to an ordinary magazine, which is problematic in terms of magazine-related accessories.

A latent drawback of prior art references is that they do not disclose retro-fitting existing magazines and/or standard length magazines.

A further drawback of the invention s known in the art is the inability to use standard length magazines conjunctively with such an indicator.

An additional drawback of the prior art teachings is that the mechanisms taught are open and thus are susceptible to fouling, dirt, dust and other materials which may be detrimental to the smooth operation of a firearm based mechanism Thus it would be advantageous to provide a magazine with improved indication of its contents. Preferably, the magazine should not require a power source, and should be suited for battle-field conditions. The magazine should be easily adaptable for many different types of weapons, including assault rifles as well as small arms, without the need to modify the actual weapon. The magazine should automatically indicate the number of cartridges remaining, at all times, without the need for user intervention or actuation of the indicating mechanism, which could distract a user in a live firefight.

Furthermore, it would be advantageous to provide a mechanism that can be readily retro-fitted to existing magazines

SUMMARY OF THE INVENTION

Accordingly, it is a principal object of the present invention to provide a magazine with clear, numerical indication of its contents.

It is another principal object to provide a magazine with a simplified mechanism for indication of its contents.

The present invention provides a magazine with an indicator to display the number of cartridges present, said magazine having a magazine housing, and comprising:

a) a graduated tape having printed thereupon, a series of numbers representing the number of cartridges present in the magazine;

b) an indicator window present in the magazine housing, configured to display the portion of said tape showing an indication of the number of cartridges remaining in said magazine;

c) a cartridge advancement spring which is fully contracted when the magazine is full of cartridges and extends in stepwise fashion as each cartridge is expended;

d) a cartridge advancement plate affixed to the movable end of said cartridge advancement spring;

such that as each cartridge is expended, said cartridge advancement plate draws said graduated tape, and a respective indication of the number of cartridges remaining is displayed upon said tape in said window.

The magazine as used herein shall include any magazine capable of being used in a firearm, including but limited to, handguns, revolvers, rifles, shotguns, carbines, sub machine guns (SMG's), assault rifles and the like There has thus been outlined, rather broadly, the more important features of the invention in order that the detailed description thereof that follows hereinafter may be better understood. Additional details and advantages of the invention will be set forth in the detailed description, and in part will be appreciated from the description, or may be learned by practice of the invention.

BRIEF DESCRIPTION OF THE DRAWINGS

In order to understand the invention and to see how it may be carried out in practice, a preferred embodiment will now be described, by way of a non-limiting example only, with reference to the accompanying drawings, in which.

DETAILED DESCRIPTION OF AN EXEMPLARY EMBODIMENT

The principles and operation of the present invention may be better understood with reference to the drawings and the accompanying description, it being understood that these drawings are given for illustrative purposes only and are not meant to be limiting.

In general, the magazine of the invention has an ammunition indicating window, displaying within a numerical value indicative of the number of cartridges remaining within the magazine. The displayed value is controlled mechanically, by means of a spring-biased graduated tape, which winds or unwinds to match the number of cartridges remaining. One end of the graduated tape is fixed to the cartridge advancement plate, such that movement of the cartridge advancement plate, results in respective winding or unwinding of the graduated tape.

Figure 1:
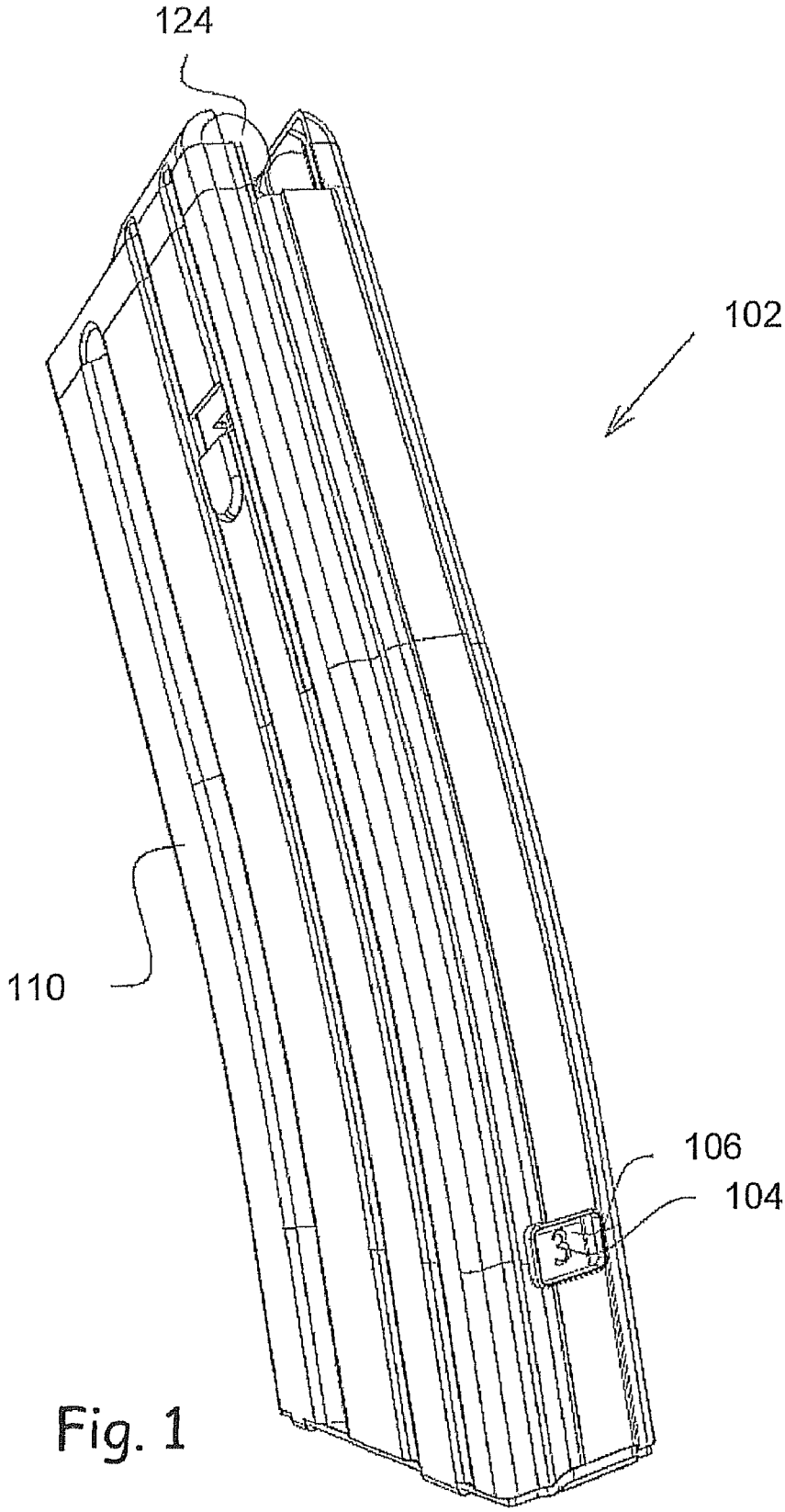
FIG. 1 is a diagrammatic representation of the magazine showing a window indicating the number of cartridges, constructed according to the principles of the present invention.

FIG. 1 is a diagrammatic representation of a magazine 102 of the invention, having an ammunition indicator window 106, wherein the window displays the number of cartridges present. A numerical value 104 representing the number of cartridges present is shown in the indicator window 106. The numerical value is printed upon graduated tape (best shown in FIGS. 2, 4), which is stretched below the display window. The graduated tape is preferable manufactured of metal. Indicator window 106 is preferably covered with transparent plastic, or may be open to the environment. A user may quickly glance at the numerical value 104 displayed in the indicator window 106, to see whether the contents of the magazine are in danger of depletion. The magazine casing 110 is shown, and the end of the top-most cartridge 124 is visible.

Preferably, the indicator window 106 is located near the lower third of the magazine, as shown in FIG. 1, on the thin side of the magazine that faces the user when the magazine is inserted in the weapon. The inventors have determined that this area will face the user at all times, so that a quick glance will suffice to view the number of cartridges with minimum effort. The enemy will be unable to view the display due to its location and size. The display cannot be read from a distance of several feet.

Figure 2:
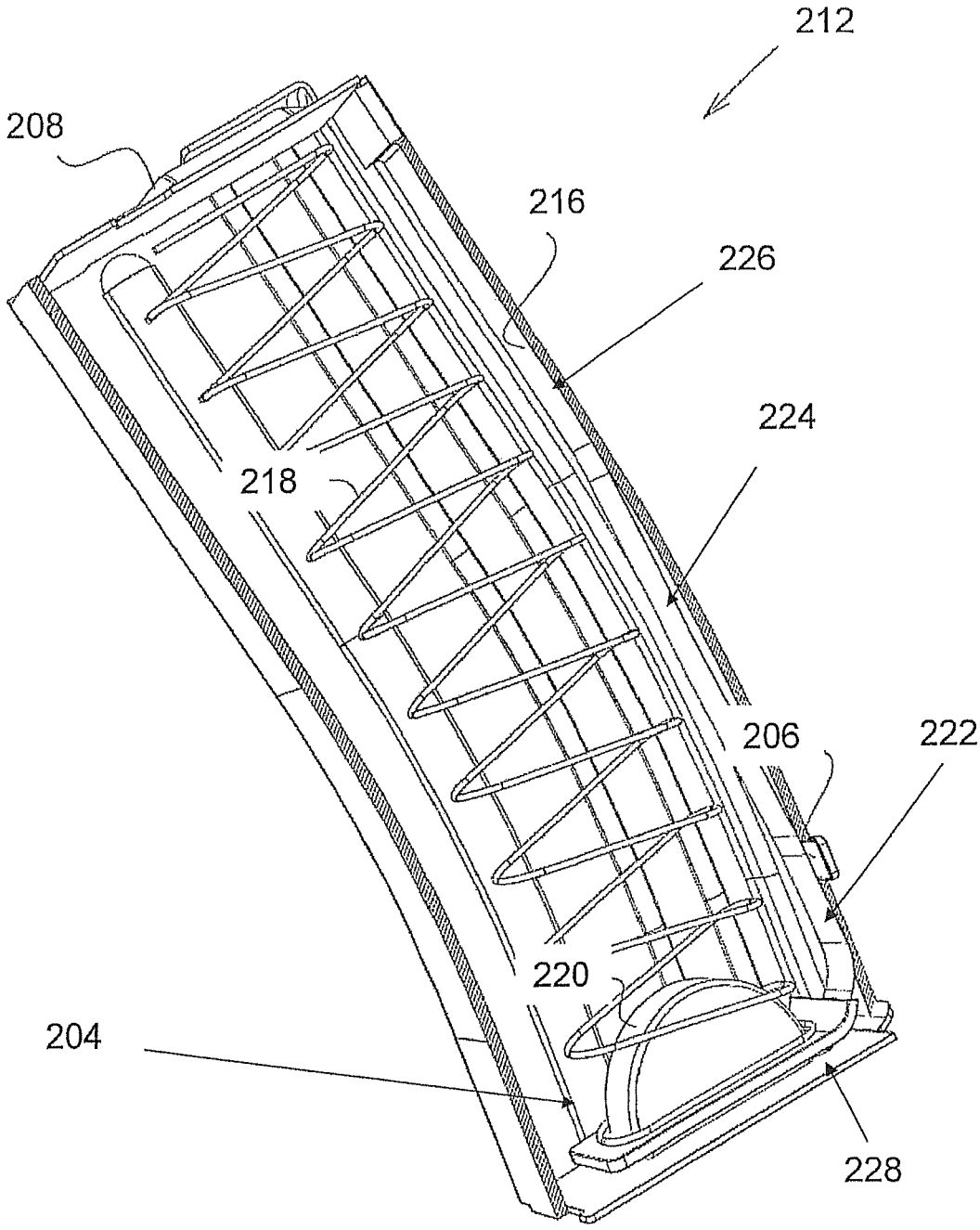
FIG. 2 is a cutaway representation of the empty magazine showing the graduated tape used to indicate the number of cartridges present, constructed according to the principles of the present invention.

FIG. 2 is a cutaway representation of an indicator mechanism 204 situated in a magazine 212 constructed according to the principles of the present invention. The Figure depicts the back of the indicator window 206, the fully extended graduated tape 216 used to display the number of cartridges present, and a perspective view of the tape winding housing 220. The fully extended cartridge advancement spring 218 and the fully extended cartridge advancement plate 208, upon which cartridges rest, are also shown. Since all cartridges have been expended, cartridge advancement plate 208 has reached the top of the magazine. One end of the graduated tape 216 is attached to the cartridge advancement plate 208, and the graduated tape 216 has been fully extended from its housing 220. The numerical value shown in the indicator window 206 will read "empty" or "zero". Optionally, the coloring may be highly visible near the "empty/zero" mark.

Preferably, tape winding housing 220 is substantially fouling resistant. Alternatively, tape winding housing 220 is fouling proof.

Preferably, tape winding housing 220 is substantially water resistant. Alternatively, tape winding housing 220 is water proof.

Optionally, it is envisaged that graduated tape 216 can be replaced by a string, a cord, a metallic tape, a flat spring wither metallic or non-metallic and the like.

Preferably, graduated tape 216 includes at least two "zones" indicating varying levels of magazine status. Namely and as shown in FIG. 2, graduated tape includes a "red" zone 222 for readily indicating the number of cartridges remaining in the magazine is very low and thus providing a visual stimuli for the user to reload.

Preferably, graduated tape 216 includes a "yellow" zone 224 for readily indicating the number of cartridges remaining in the magazine is low and thus providing a visual stimuli for the user to either reload or prepare to reload.

Preferably, graduated tape 216 includes a "green" zone 226 for readily indicating the number of cartridges remaining in the magazine is satisfactory, thus providing a visual stimuli for the user that a reload is not presently required.

Preferably, "red" zone 222 can be readily "set" to indicate any predetermined number of cartridges as the user, department or manufacturing company may see fit.

Preferably, "yellow" zone 224 can be readily "set" to indicate any predetermined number of cartridges as the user, department or manufacturing company may see fit.

Preferably, "green" zone 226 can be readily "set" to indicate any predetermined number of cartridges as the user, department or manufacturing company may see fit.

Preferably, tape winding housing 220 can be readily aligned such that, in use, graduated tape 216 does no come into contact with cartridge advancement spring 218.

Preferably and as shown in FIG. 2, magazine 212 can be a standard length and style magazine and thus is readily retrofitted and/or manufactured including indicator mechanism 204.

Optionally, magazine 212 is an assault rifle magazine or a carbine magazine.

Optionally, magazine 212 is selected from the group consisting of an M-16 magazine, an M-4 magazine, an AR-15 magazine, an AK-47 magazine, an AK-74 magazine, an AKM magazine, a H&K G36 magazine, a H&K 416 magazine, an H&K MP5 magazine, an H&K94 magazine, a SCAR magazine, a Tavor magazine, a Galil Magazine, an Uzi magazine, an XM8 magazine, an M21 magazine and any derivative thereof.

Preferably and as shown in FIG. 2, magazine 212 can be a standard length and style magazine and thus can be readily manufactured including indicator mechanism 204.

Preferably, an aperture 228 is formed in the base of magazine 212 for readily displaying an indication of the number of cartridges in magazine 212 through the base of magazine 212. Thus a user can readily inspect a single magazine in a holster, a pouch or a carrier and immediately discern the status of magazine 212.

Furthermore, it is envisaged that aperture 228 for displaying the status of magazine 212 by viewing graduated tape 216 either solely or conjunctively with the use of indicator window 206.

Thus, a user can readily inspect a plurality of magazines 212 on a ballistic vest, load bearing vest, pouches, carriers and the like by simply viewing the bases of magazines 212.

Figure 3:
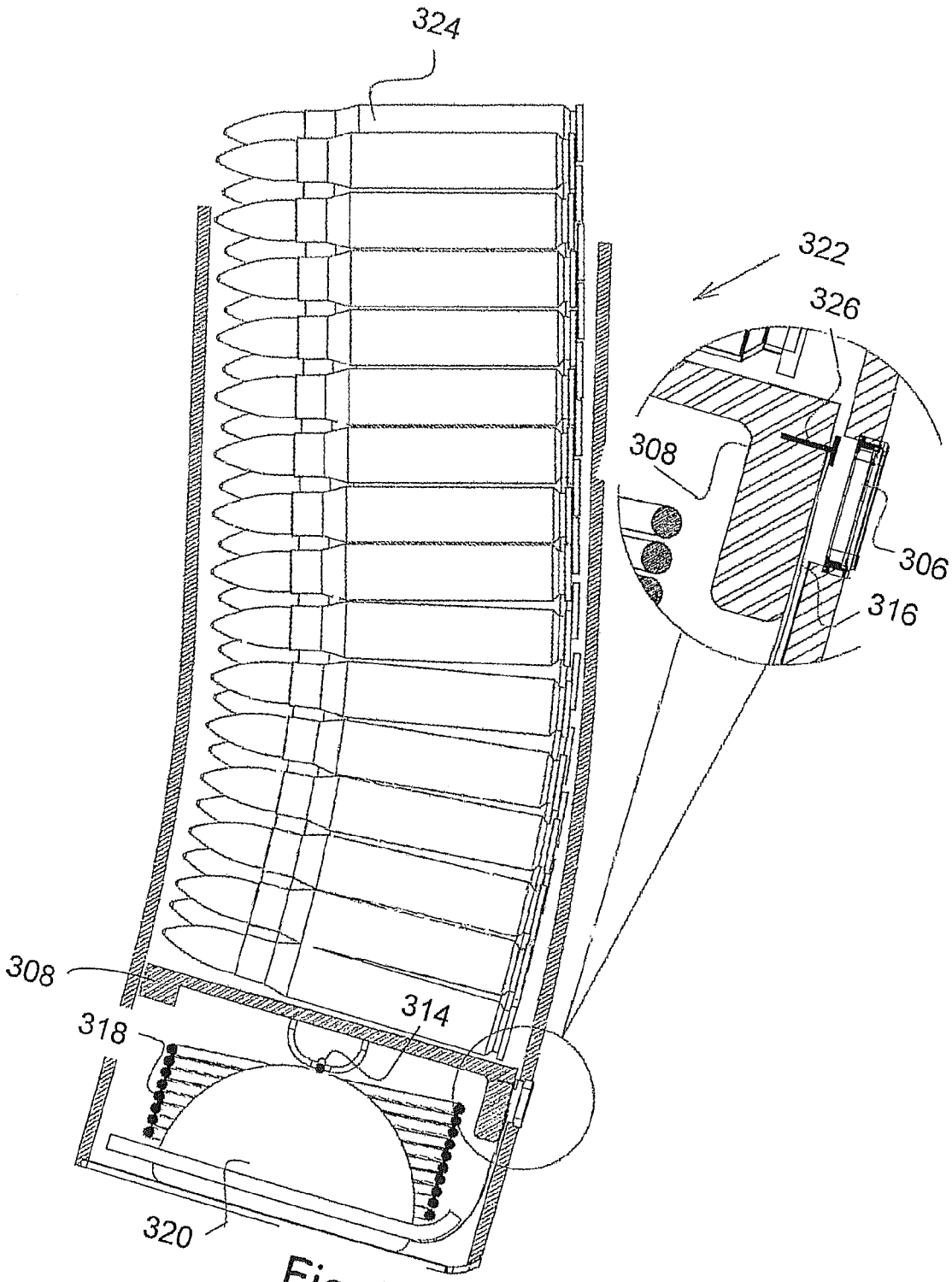
FIG. 3 is a cutaway representation of the magazine when it is full, with an exploded view of the indicator window area, constructed according to the principles of the present invention.

FIG. 3 is a cutaway representation of the magazine 322 when it is full, with an exploded view of the indicator window area, constructed according to the principles of the present invention. Depicted are the topmost cartridge 324, and the fully contracted cartridge advancement spring 318. A side view of the graduated tape winding housing 320 is shown, and the spring/plate connector 314 is shown. The exploded view of the indicator window area includes an edge of the fully retracted cartridge advancement plate 308, which is attached by means of pin 326 to the end of the graduated tape 316. A side view of the indicator window 306 is shown. Since cartridge advancement plate 308 is fully retracted, the attached graduated tape 316 is similarly fully retracted within its housing 320, and thus will display the numerical value corresponding to a full magazine, within the indicator window 306.

Alternatively, the graduated tape may be fixed to the cartridge advancement plate by means of a spring.

Since the graduated tape 316 and its housing 320 are located beneath the cartridge advancement plate 308, they do not contact the cartridges and will therefore not interfere with loading of the magazine or with use of the weapon.

As the cartridges are expended, and cartridge advancement plate 308 is driven by cartridge advancement spring 318 upwards towards the top of the magazine 322, graduated tape 316 will be pulled by cartridge advancement plate 308 and unwound from within its housing 320, to show a continuously lower number within the indicator window 306.

Optionally, the last few numbers printed upon the graduated tape may be printed in a highly visible color or may have a highly visible background color, so that a user may be made aware of the imminent need to reload the weapon.

Figure 4:
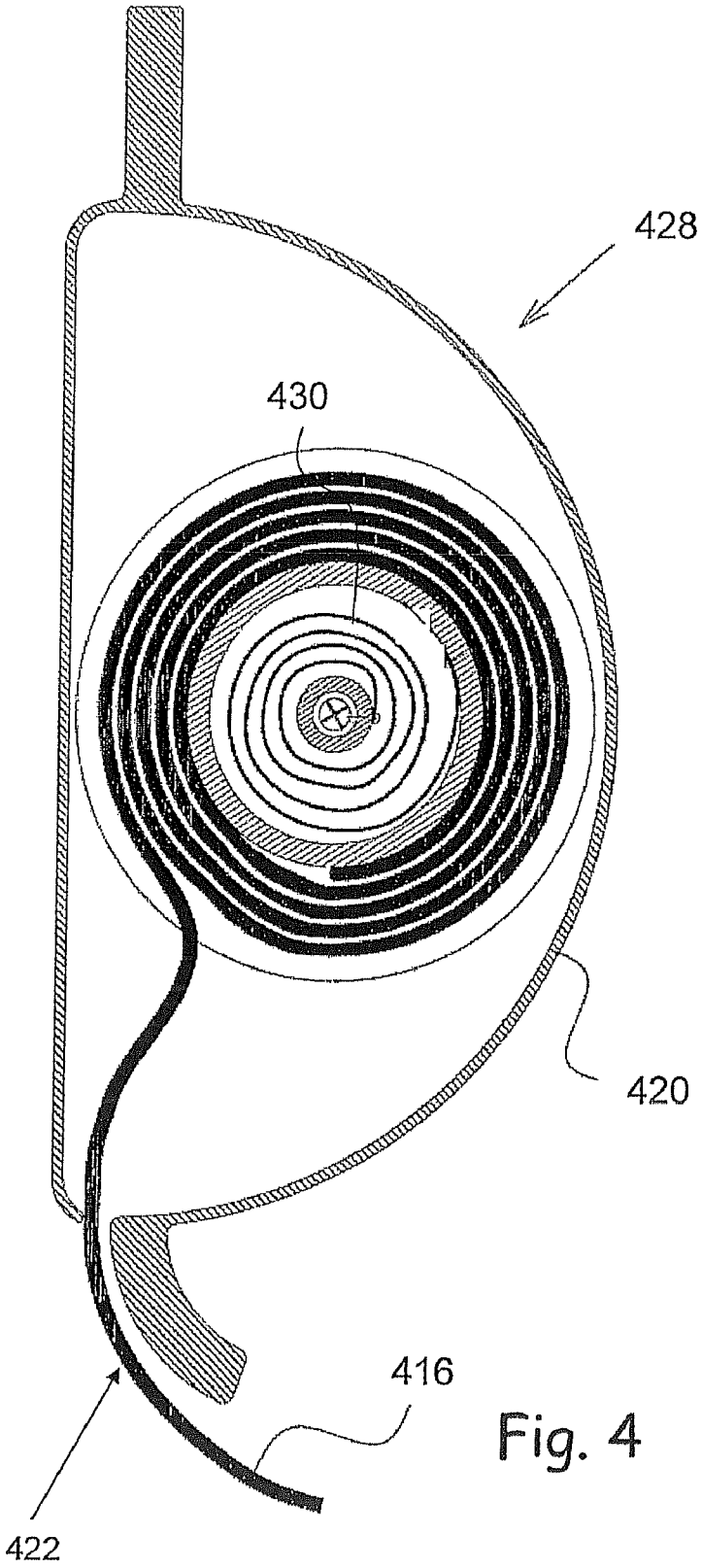
FIG. 4 is a cutaway representation of the graduated tape winding mechanism, constructed according to the principles of the present invention.

FIG. 4 is a cutaway representation of the graduated tape winding mechanism 428, constructed according to the principles of the present invention. Inside the cutaway edge of graduated tape winding housing 420 are revealed the details of storage of the tape. The initially protruding portion of the tape 416 is fed out of housing 420. A fixed spring 430 winds and unwinds inside a concentric inner chamber of tape winding housing 420 as tape 416 extends and retracts. Fixed spring 430 returns tape 416 to its place.

Preferably, tape 416 includes a visual indicator 422 for indicating the magazine status.

Preferably, mechanism housing 420 is aligned with indicator 422 for readily accommodating mechanism 428 for indicating the magazine status.

Preferably, mechanism 428 for indicating the magazine status encased in housing 420.

Preferably, mechanism 428 for indicating the magazine status is substantially fouling resistant.

Preferably, mechanism 428 for indicating the magazine status is substantially water resistant.

Optionally, mechanism 428 for indicating the magazine status is substantially fouling proof.

Optionally, mechanism 428 for indicating the magazine status is substantially water proof.

Preferably, tape 416 is includes and/or is colored with a phosphorus compound, fluorescent and/or luminescent such that indicator 422 is readily viewable in any light condition.

The magazine is suitable for small arms or for any other type of gun, such as an assault rifle.

Having a relatively small number of components, the indicating magazine of the invention is inexpensive to manufacture, and may thus be suited for mass manufacture, such as for military use. The relatively simple design results in less chance of fouling of the mechanism. The indicating magazine is not sensitive to humidity, and is suited for battlefield use, since the display will be invisible to the enemy from any distance, and will not emit light which could bring to unwanted detection of the user.

The user does not need to actuate the indicating mechanism, which is active at all times to display the number of cartridges remaining. This is especially advantageous in a live firefight, since no additional steps, which could be distracting, are necessary in order to determine how many cartridges remain.

Having described the present invention with regard to certain specific embodiments thereof, it is to be understood that the description is not meant as a limitation, since further modifications will now suggest themselves to those skilled in the art, and it is intended to cover such modifications as fall within the scope of the appended claims.

We claim:

1. A magazine with an indicator to display the number of cartridges present, said magazine having a magazine housing, and comprising:

a) a graduated tape having printed thereupon, a series of numbers representing the number of cartridges present in the magazine;

b) an indicator window present in the magazine housing, configured to display the portion of said tape showing an indication of the number of cartridges remaining in said magazine;

c) a cartridge advancement spring which is fully contracted when the magazine is full of cartridges and extends in stepwise fashion as each cartridge is expended;

d) a cartridge advancement plate affixed to the movable end of said cartridge advancement spring; such that as each cartridge is expended, said cartridge advancement plate draws said graduated tape, and a respective indication of the number of cartridges remaining is displayed upon said tape in said window; and wherein said magazine housing further comprises a graduated tape housing, said tape housing is located beneath said cartridge advancement plate and within the internal space of said cartridge advancement spring.

2. The magazine of claim 1, further comprising a fixed spring biased to rewind said tape onto itself.

3. The magazine of claim 2, wherein said cartridge advancement plate is affixed to one end of said graduated tape, thus movement of said cartridge advancement plate draws and unwinds said graduated tape.

4. The device of claim 3, wherein said cartridge advancement plate is affixed to said tape by a pin or a spring.

5. The device of claim 1, wherein said graduated tape is retracted and coiled in said tape housing as each cartridge is added to the magazine.

6. The device of claim 1, wherein a portion of said graduated tape, related to near depletion of said magazine, is highly visible, due to a highly visible ink, or to a highly visible background color of said portion of graduated tape.

7. The device of claim 1, wherein said indicator window comprises a transparent plastic cover.

8. The device of claim 1, wherein said magazine is suited for small arms or for an assault rifle.

9. The device of claim 1, wherein said graduated tape, and said indicator window are located below said cartridge advancement plate, thereby preventing fouling of said tape in said cartridges during use of said magazine.

10. The device of claim 1, wherein said graduated tape is manufactured of metal.

11. The device of claim 1, wherein said indicator window is located near the lower third of said magazine, on a thin side of said magazine, which faces a user when said magazine is inserted within a weapon.

12. The device of claim 1, wherein said indicator tape displays the number of cartridges remaining in said magazine at all times, without the need to actuate the mechanism during use.

13. The device of claim 1, wherein said display mechanism is resistant to humidity.

14. The device of claim 1, wherein said tape is affixed to said cartridge advancement plate by a spring.

* * * * *